US011426004B1

(12) United States Patent
Aubé et al.

(10) Patent No.: US 11,426,004 B1
(45) Date of Patent: Aug. 30, 2022

(54) MODULAR SEAT ASSEMBLY AND METHOD OF ASSEMBLY THEREOF

(71) Applicant: COZEY INC., Montreal (CA)

(72) Inventors: Frédéric Aubé, Montréal (CA); Zhijie Gu, Haining (CN)

(73) Assignee: COZEY INC., Quebec (CA)

( * ) Notice: Subject to any disclaimer, the term of this patent is extended or adjusted under 35 U.S.C. 154(b) by 0 days.

(21) Appl. No.: 17/302,047

(22) Filed: Apr. 22, 2021

(51) Int. Cl.
*A47C 13/00* (2006.01)

(52) U.S. Cl.
CPC ..... *A47C 13/005* (2013.01)

(58) Field of Classification Search
CPC ..... A47C 13/005; A47C 13/00; A47C 1/124
USPC ..... 297/440.14
See application file for complete search history.

(56) References Cited

U.S. PATENT DOCUMENTS

| | | | | |
|---|---|---|---|---|
| 5,314,234 | A * | 5/1994 | England | A47C 13/005 297/248 |
| 5,352,017 | A | 10/1994 | Berning | |
| 5,931,529 | A | 8/1999 | LaPointe et al. | |
| 6,241,317 | B1 * | 6/2001 | Wu | A47C 4/02 297/440.1 |
| 6,715,837 | B2 | 4/2004 | Niederman et al. | |
| 6,758,450 | B2 * | 7/2004 | Niederman | A47C 4/02 248/200 |
| 7,300,111 | B2 | 11/2007 | Huang | |
| 7,962,975 | B2 * | 6/2011 | Hartline | A47C 17/225 5/51.1 |
| 8,356,954 | B2 * | 1/2013 | Koch | A47C 17/02 403/353 |
| 9,125,494 | B2 | 9/2015 | Helton | |
| 9,380,877 | B2 | 7/2016 | Brandtner et al. | |
| 10,182,659 | B2 | 1/2019 | Kuhl et al. | |
| 10,433,648 | B1 * | 10/2019 | Kuhl | A47C 17/04 |
| 11,076,700 | B2 * | 8/2021 | Kuhl | A47C 17/04 |
| 2005/0179303 | A1 * | 8/2005 | Owens | A47C 4/02 297/440.1 |
| 2007/0029859 | A1 * | 2/2007 | Huang | A47C 13/005 297/440.2 |

FOREIGN PATENT DOCUMENTS

| | | |
|---|---|---|
| GB | 1279618 A | 6/1972 |

* cited by examiner

*Primary Examiner* — Mark R Wendell
(74) *Attorney, Agent, or Firm* — Lavery, de Billy, L.L.P.; Gonzalo Lavin

(57) ABSTRACT

Modular seat assembly having a female connector that is positioned and configured to releasably connect to a corresponding male stud connector on an adjacent seat module. Each female connector includes a plate comprising a raised portion defining an upper opening leading to a downwardly angled channel extending at about 20 degrees to about 70 degrees from a vertical axis into a horizontal portion, such that each male stud connector is slidably and releasably connectable to each corresponding female connector, and such that the channel and the horizontal portion have a width that is narrower than a head of the male stud connector, but wider than a neck of the male stud connector; and wherein said male stud connector is configured to be guided downward by said channel and then loosely contained within said horizontal portion.

17 Claims, 9 Drawing Sheets

(b)

(a)

MODULAR SEAT ASSEMBLY AND METHOD OF ASSEMBLY THEREOF

FIELD OF THE INVENTION

The present invention relates to a modular seat assembly, as well as a method of assembling said modular seat assembly.

BACKGROUND OF THE INVENTION

Modular seat assemblies are known in the art. For example, U.S. Pat. Nos. 10,433,648 and 10,182,659 by KUHL disclose a modular sofa that is assembled by aligning integrated connectors of seating modules and armrest modules, with each respective connector slidingly engaged along an axis. However, these modules are relatively difficult to assemble for a customer as a long pin has to perfectly align into a corresponding slot. Furthermore, these modules are relatively expensive to manufacture as the male and female hardware are integrated inside each of the modules with specialized tooling to do so. Moreover, in the case of a defect or a broken piece on the hardware, it is difficult for a customer to replace it on their own, especially when the hardware is located in places that are unreachable.

Also known are U.S. Pat. No. 9,380,877 (BRANDNER), U.S. Pat. No. 9,125,494 (HELTON), U.S. Pat. No. 7,300,111 (HUANG), U.S. Pat. No. 6,715,837 (NIEDERMAN), U.S. Pat. No. 5,931,529 (LAPOINTE), and U.S. Pat. No. 5,352,017 (BERNING), which disclose modular assemblies which suffer from similar drawbacks of having integrated male and female hardware assemblies that may be relatively difficult to assemble and/or are relatively expensive to manufacture.

There is therefore a need in the market for a modular seat assembly that is easier to assemble than prior known modular systems, that is relatively less expensive to manufacture and to repair and that is relatively easy to pack in a small volume for shipping.

SUMMARY OF THE INVENTION

In accordance with the present invention, there is provided a modular seat assembly, comprising, a left arm module and a right arm module, each of a right exterior surface of the left arm module and a left exterior surface of the right arm module comprising at least one male stud connector or at least one female connector, at least one seat module comprising a sitting portion and a backrest portion, each of a right exterior surface and a left exterior surface of each seat module comprising one or more male stud connectors or one or more female connectors, wherein each female connector is positioned and configured to releasably connect to a corresponding male stud connector on an adjacent seat module, on the right arm module, or on the left arm module; wherein each female connector comprises a plate comprising a raised portion defining an upper opening leading to a downwardly angled channel extending at about 20 degrees to about 70 degrees from a vertical axis into a horizontal portion, such that each male stud connector is slidably and releasably connectable to each corresponding female connector, and such that the channel and the horizontal portion have a width that is narrower than a head of the male stud connector, but wider than a neck of the male stud connector; and wherein said male stud connector is configured to be guided downward by said channel and then loosely contained within said horizontal portion.

In embodiments, the left arm module comprises two female connectors or two male stud connectors on the right exterior surface thereof, and the right arm module comprises two male stud connectors or two female connectors on the left exterior surface thereof.

In embodiments, the plate of the female connector is secured to a back plate that is attachable to the exterior surface of its corresponding module.

In embodiments, the upper opening is of a gradually decreasing width, such that is it about the same width as the channel once it reaches the channel.

In embodiments, the downward angle of the channel is about 30 degrees.

In embodiments, each seat module comprises both one or more male stud connectors on one side thereof and one or more female connectors on the other side thereof.

In embodiments, the modular seat assembly further comprises a plurality of leg modules, each of an edge of a right side of a bottom exterior surface of the left arm module and an edge of a left side of a bottom exterior surface of the right arm module comprise at least one latch or at least one latch receiving means and further comprise at least one leg module receiving means, and each of an edge of a right side and an edge of a left side of a bottom exterior surface of each seat module comprises one or more latches or one or more latch receiving means and further comprises one or more leg module receiving means, wherein each latch receiving means is positioned and configured to releasably connect to a corresponding latch, respectively, on an adjacent seat module, on the right arm module, or on the left arm module, and each leg module receiving means is positioned so as to be adjacent to another leg module receiving means on an adjacent seat module, on the right arm module, or on the left arm module, such that each leg module is releasably connectable to two adjacent leg module receiving means.

In embodiments, the latches are toggle latches, and the latch receiving means are latch plates configured to receive the toggle latches.

In embodiments, each leg module is releasably connectable to two adjacent leg module receiving means using hand screws.

In embodiments, the sitting portion and the backrest portion are releasably connectable to each other.

In embodiments, the bottom exterior surface of the backrest portion comprises a plurality of pins configured to be received by a plurality of openings in the top exterior surface of the sitting portion, such that the sitting portion and the backrest portion are releasably connectable to each other.

In embodiments, the modular seat assembly comprises three seat modules, such that the modular seat assembly forms a sofa once assembled.

In embodiments, the modular seat assembly comprises a single seat module, such that the modular seat assembly forms a chair once assembled.

According to the present invention, there is also provided a connector assembly for a modular seat assembly, the connector assembly comprising: a female connector including a plate comprising a raised portion defining an upper opening leading to a downwardly angled channel extending at about 20 degrees to about 70 degrees from a vertical axis into a horizontal portion; and a male stud connector configured to be guided downward by said channel and then loosely contained within said horizontal portion.

According to the present invention, there is also provided a method of assembling the modular seat assembly, comprising: releasably connecting the left arm module, the at least one seat module, and the right arm module together by slidably connecting each male stud connector to a corresponding female connector, such that the at least one seat module is bookended by the left arm module and the right arm module; wherein the step of slidably connecting each male stud connector to a corresponding female connector comprises sliding each male stud connector through the opening of the corresponding female connector, and through the downwardly angled channel extending into the horizontal portion.

In embodiments of the method, the step of releasably connecting the left arm module, the at least one seat module, and the right arm module together is performed from left to right or right to left.

In embodiments of the method, if not properly aligned, the seat modules, the left arm module, and the right arm module are aligned together by sliding the appropriate male stud connectors along the horizontal portions.

In embodiments, the method further comprises the steps of releasably connecting each leg module to two adjacent leg module receiving means, followed by releasably engaging each latch with its corresponding latch receiving means.

In embodiments, the method comprises flipping the modular seat assembly on its back after slidably connecting each male stud connector to a corresponding female connector.

In embodiments, the method comprises, prior to releasably connecting the left arm module, the at least one seat module, and the right arm module together, the step of releasably connecting each backrest portion with each sitting portion.

DETAILED DESCRIPTION OF THE ILLUSTRATIVE EMBODIMENTS

Figure 1:
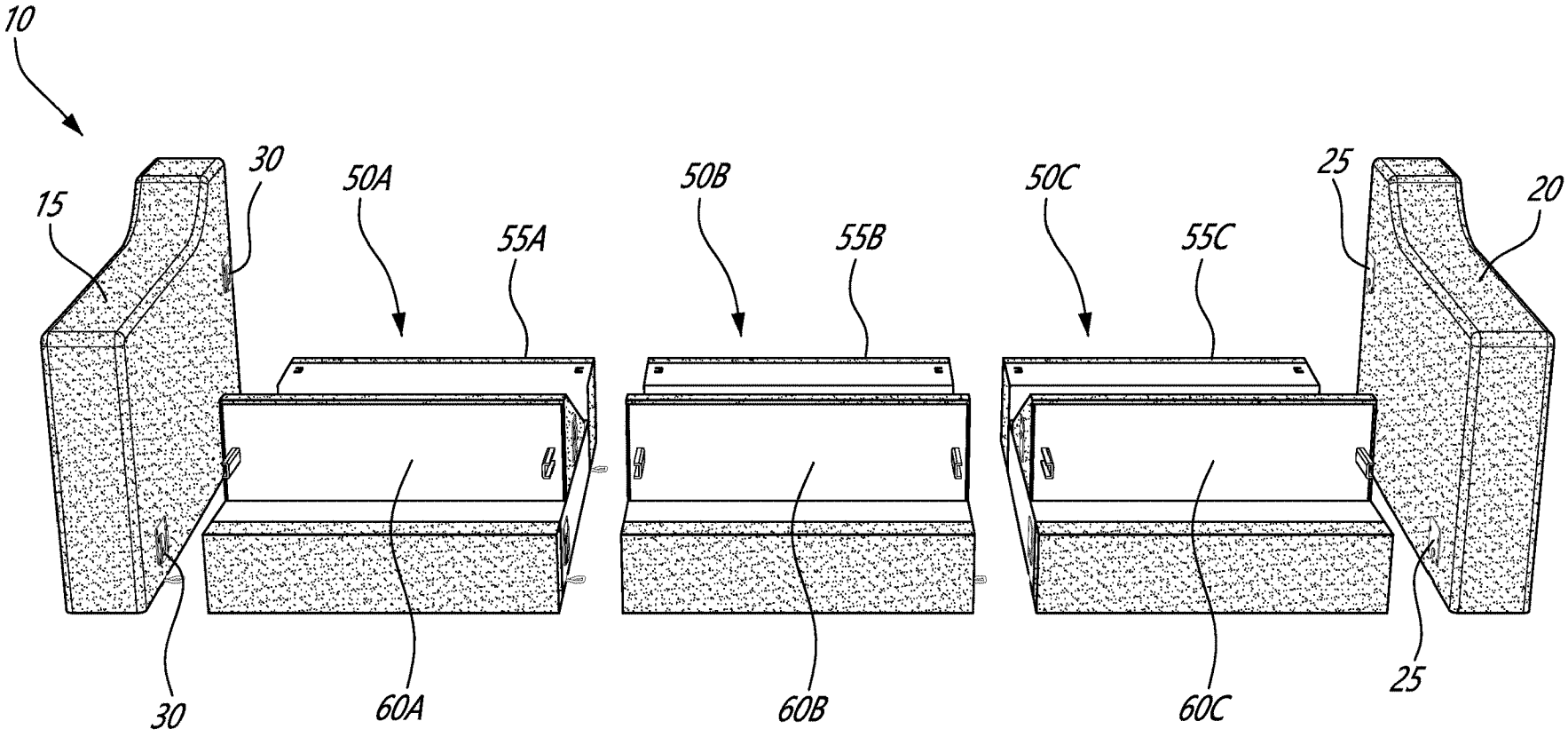
FIG. 1 is a front isometric view of a modular seat assembly in a disassembled form according to an embodiment of the present invention.

Referring first to FIG. 1, a modular seat assembly, generally referred to using the reference numeral 10, will be described. For clarity, the modular seat assembly in FIG. 1 has not yet been assembled, and is therefore in a disassembled form. The modular seat assembly 10 comprises a left arm module 15 and a right arm module 20. As shown in FIG. 1, each of a right exterior surface of the left arm module 15 and a left exterior surface of the right arm module 20 comprise at least one male stud connector 25 or at least one female connector 30. In preferred embodiments (and as shown for example in FIG. 1), each of the right exterior surface of the left arm module 15 and the left exterior surface of the right arm module 20 comprise two male stud connectors 25 or two female connectors 30.

As also shown in FIG. 1, the modular seat assembly further comprises at least one seat module 50A 50B 50C comprising a sitting portion 55A 55B 55C and a backrest portion 60A 60B 60C. Each of a right exterior surface and a left exterior surface of each seat module 50A 50B 50C comprises one or more male stud connectors 25 or one or more female connectors 30. It should be noted that said connectors can be located on the backrest portion and/or the sitting portion (in the embodiment shown in FIG. 1, they are located on both).

Each female connector 30 is positioned and configured to releasably connect to a corresponding male stud connector 25 on an adjacent seat module 50A 50B 50C, on the right arm module 20, or on the left arm module 15. As an example, and as shown in FIG. 1, male stud connectors 25 on the right arm module 20 are positioned such that they are releasably connectable to two corresponding female connectors (not shown) on the right exterior surface of the right-most seat module 50C.

The skilled person would understand that different amounts of male and female connectors can be used, so long as each male stud connector 25 has a corresponding female connector 30 to which to connect when the modular seat assembly 10 is assembled. The skilled person would also understand that the purpose of the male stud connectors 25 and female connectors 30 is to allow a user to easily secure the left arm module, the right arm module, and the seat modules to each other. While using more male and female connectors will generally render the resulting assembly more secure, it will also increase manufacturing costs and render the assembly more difficult and/or cumbersome to assemble.

In the embodiment shown in FIG. 1, the left arm module 15 comprises two female connectors 30 on the right exterior surface thereof, while the right arm module comprises two male stud connectors 30 on the left exterior surface thereof. However, in alternative embodiments, the left arm module 15 can comprise male stud connectors 30 on the right exterior surface thereof, while the right arm module can comprise female connectors 30 on the left exterior surface thereof.

The present inventors discovered that by using the specific female connector and male stud connector defined above and below, the modular seat assembly is rendered more easily assemblable, more secure once assembled, and more easily adjustable once assembled when compared to conventional modular seat assemblies.

Figure 2:
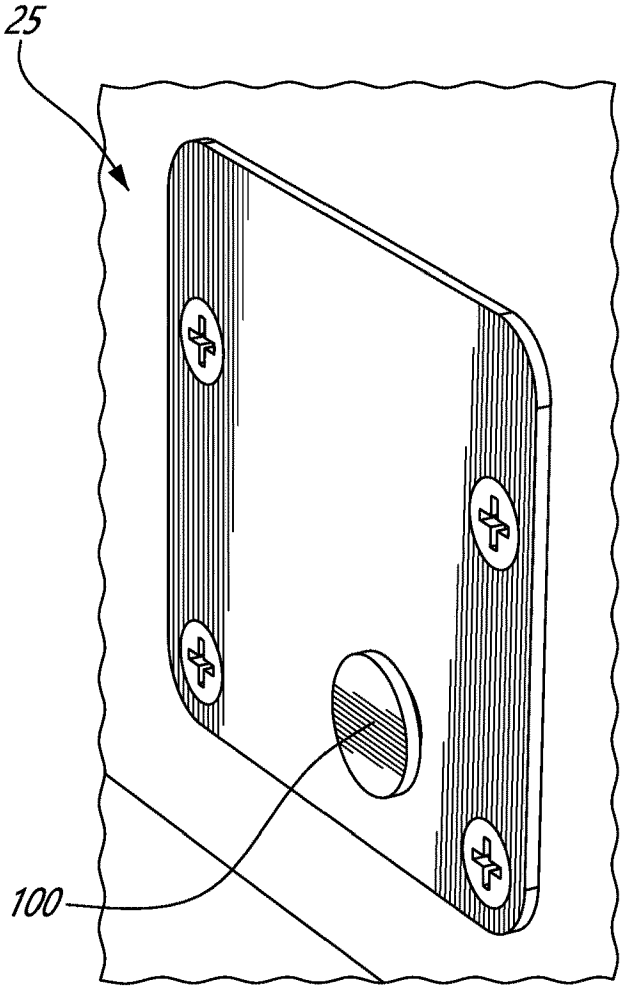
FIG. 2 is an isometric view of (a) a female connector and (b) a male stud connector used in the modular seat assembly of FIG. 1.
Figure 2:
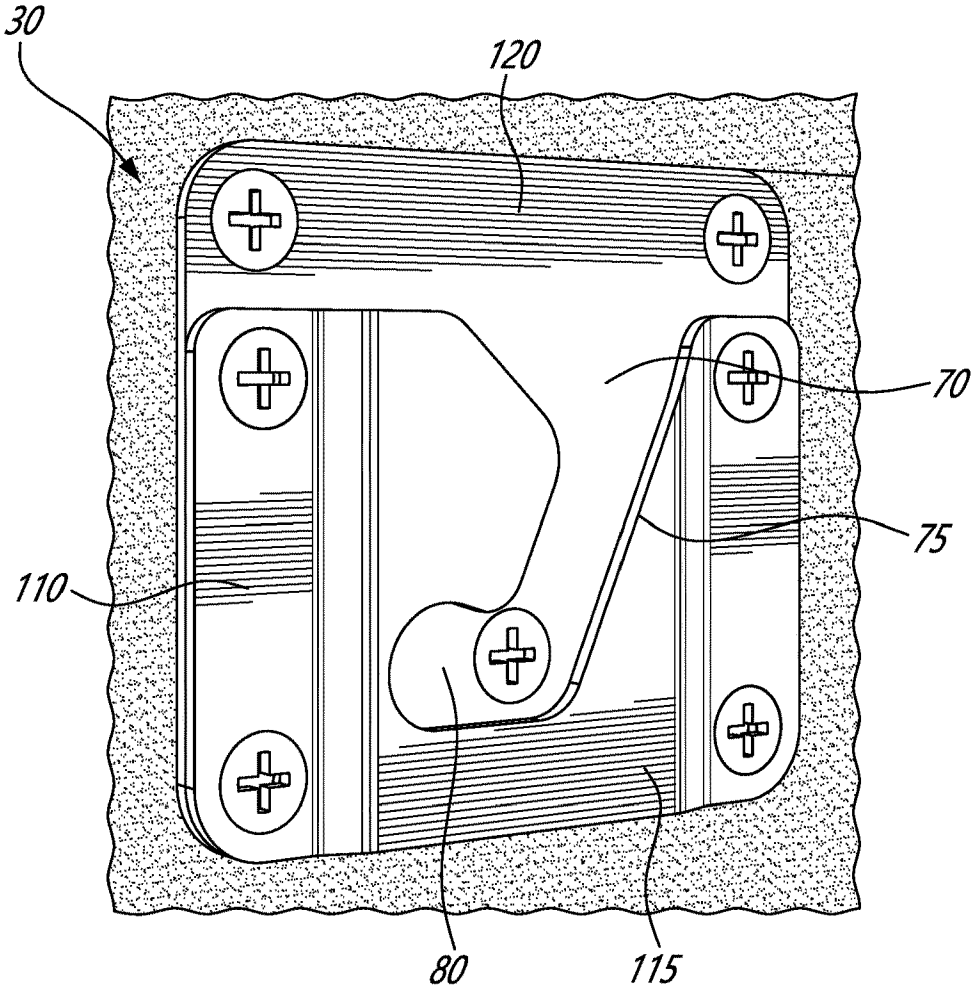

In the modular seat assembly of the present invention, as shown in FIG. 2, each female connector 30 comprises a plate 110 comprising a raised portion 115 defining an upper opening 70 leading to a downwardly angled channel 75 extending at about 20 degrees to about 70 degrees from a vertical axis into a generally horizontal portion 80, such that each male stud connector 25 is slidably and releasably connectable to each corresponding female connector 30. This type of connector assembly makes it simple to connect the various modules of the modular seat assembly together, as the male stud connector 25 is simply inserted into the opening 70, after which the male stud connector 25 can be easily slid down the downwardly angled channel 75 until it reaches the horizontal portion 80, where it will remain due to gravity.

The skilled person understands that the channel 75 and the horizontal portion 80 hold the male stud connector 25 in place by having a width that is narrower than the head 100 of the male stud connector 25, but wider than the neck of the male stud connector 25. Once in the horizontal portion, each male stud connector 25 can be slid forward until the seat modules, the left arm module, and the right arm module are aligned. By being able to slide the male stud connector along the horizontal channel, the seat modules, the left arm module, and the right arm module are more easily alignable and adjustable when compared to conventional modular seat assemblies.

In embodiments, the plate 110 of the female connector 30 is secured directly to the exterior surface of its corresponding module. In preferred embodiments, such as those shown in FIGS. 2 and 3, the plate 110 of the female connector 30 is secured to a back plate 120 that is itself directly attached to the exterior surface of its corresponding module.

The raised portion 115 of the plate 110 creates a gap between the raised portion 115 and either the back plate 120 (if present) or the exterior surface of the module (if no back plate is used), said gap being of sufficient width to receive the head 100 of the male stud connector and to allow the male stud connector to slide down the downwardly angled channel 75 until and to then slide along the horizontal portion 80.

Figure 3:
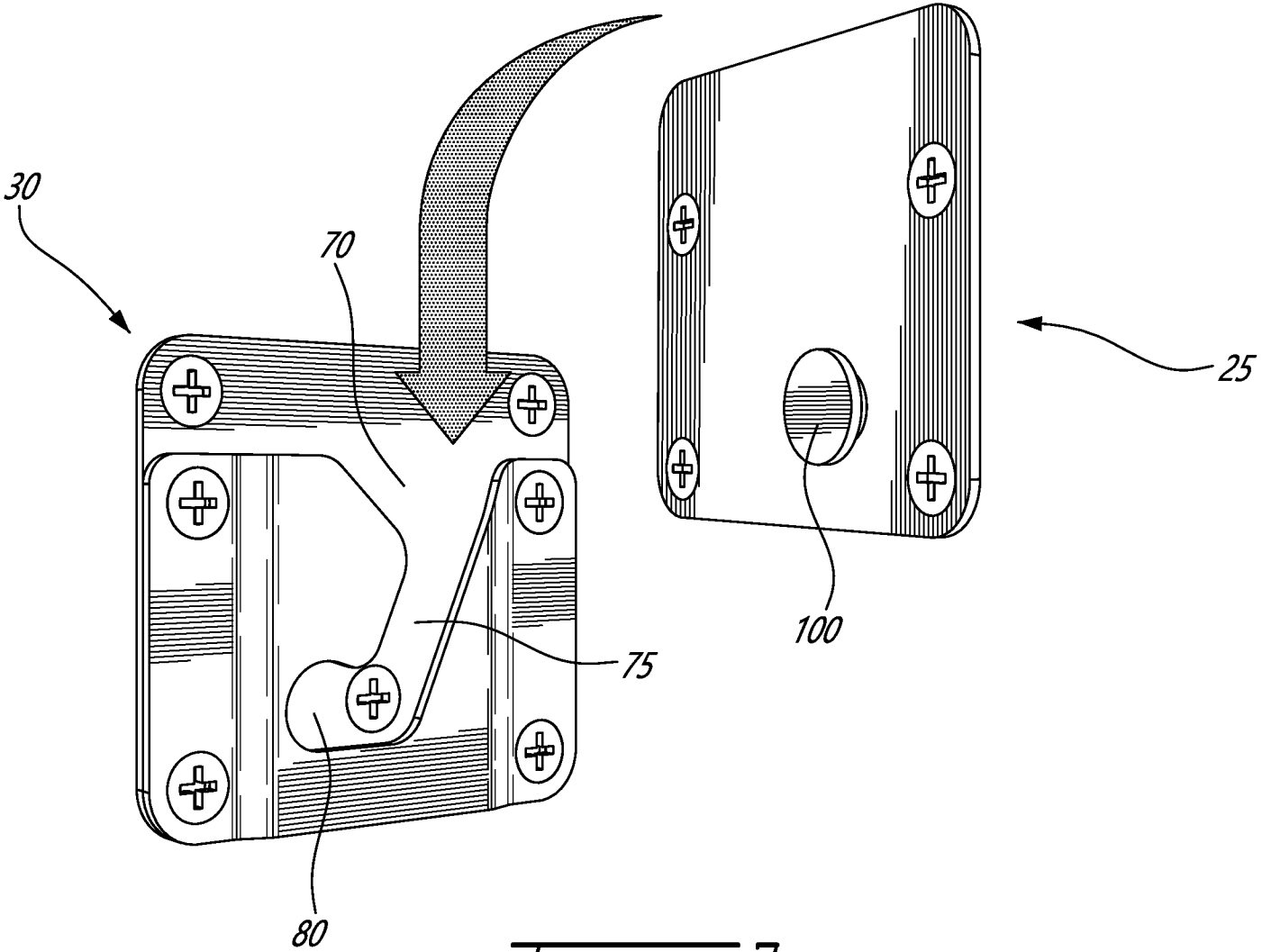
FIG. 3 is an isometric view of a female connector and a male stud connector used in a modular seat assembly of the present invention.

As shown in FIGS. 2 and 3, the female connector 30 defines an opening 70 into which the male stud connector 25 can be inserted. Accordingly, the opening should be shaped so as to easily receive the male stud connector 25. As shown in FIGS. 2 and 3, one example of such a shape is to have the opening be of a gradually decreasing width, such that it is about the same width as channel 75 once it reaches the channel 75. Such a configuration shown in FIGS. 2 and 3 allows a user to easily guide the male stud connector 25 through the opening 70 and into channel 75.

The downward angle of the channel 75 should be sufficient to allow the male stud connector 25 to easily slide down said channel 75 once it is inserted into the upper opening 70, while also being sufficient to prevent the male stud connector 25, once in the generally horizontal portion 80, from being able to slide back up said channel 75 on its own. In embodiments, the downward angle of the channel is between about 20 degrees and about 70 degrees from a vertical axis, preferably between about 25 degrees and about 60 degrees, more preferably between about 30 degrees and about 50 degrees, most preferably about 30 degrees. In embodiments, the downward angle can be at least about 20 degrees, at least about 25 degrees, at least about 30 degrees, at least about 35 degrees, or at least about 40 degrees, and/or at most about 70 degrees, at most about 65 degrees, at most about 60 degrees, or at most about 55 degrees from the vertical axis.

The generally horizontal portion 80, as mentioned, is designed to secure the male stud connector 25 and female connector 30 together in such a manner that adjustments and alignments can be made to the modules of the modular seat assembly. Accordingly, the generally horizontal portion 80 should be sufficiently horizontal and straight to allow a user to easily adjust the horizontal alignment (from the perspective of the modular seat assembly being "upright", as opposed to being on its back) of the left arm module 15, the right arm module 20, and the seat modules 50A 50B 50C with respect to each other, without noticeably altering their vertical alignment. It should be noted that the horizontal alignment of the modules can still be adjusted when the modular seat assembly is tipped over on its back (in fact, as will be mentioned below, it may be preferable to align the modules by flipping the modular seat assembly on its back). However, from such a perspective, the horizontal portion 80 and the horizontal alignment would appear vertical.

Figure 4:
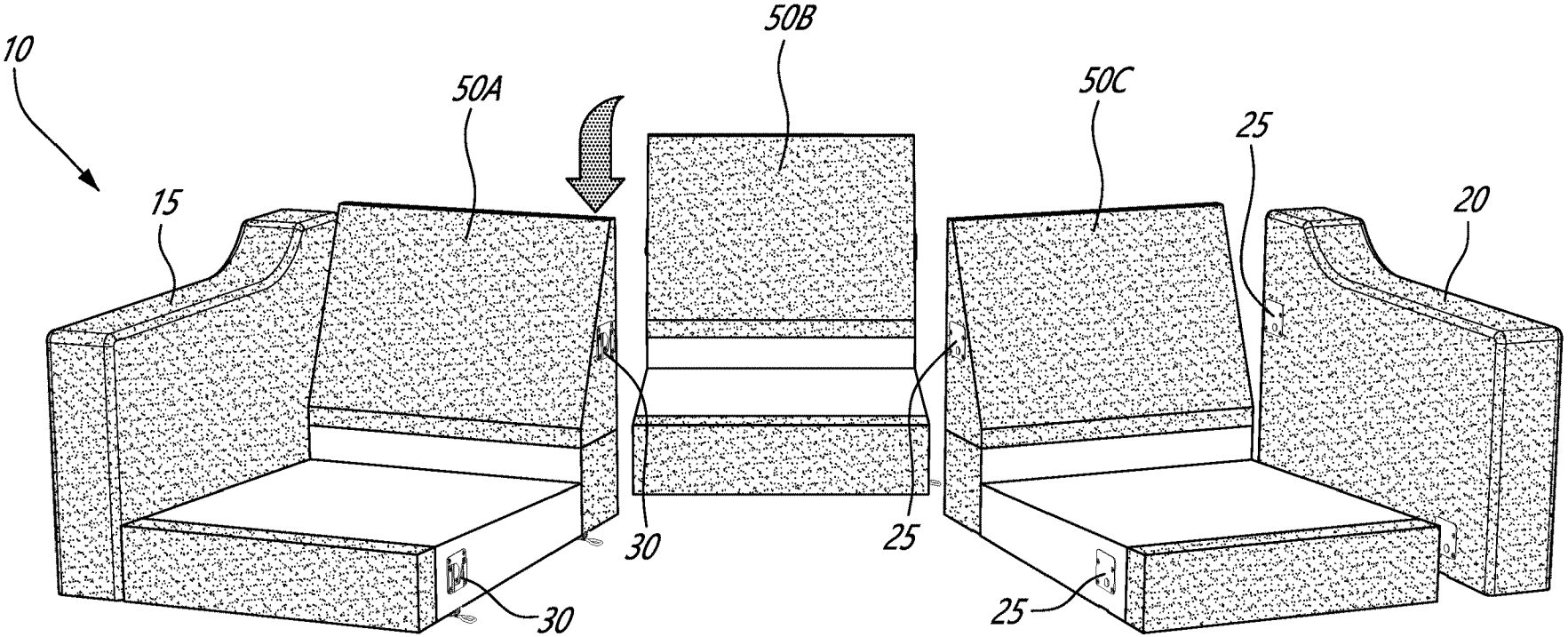
FIG. 4 is a front isometric view of the modular seat assembly of FIG. 1 in a partially assembled form.

In preferred embodiments, each seat module 50 such as 50A 50B 50C comprises one or more male stud connectors 25 on one side (left or right) exterior surface thereof, while the other side exterior surface thereof comprises one or more female connectors. For clarity, this means that in preferred embodiments, each seat module 50 will comprise both one or more male stud connectors 25 and one or more female connectors 30 (the male connectors being on one side and the female connectors being on another). Such a configuration may render the modular seat assembly 10 easier to assemble, as it can be assembled entirely from left to right or right to left (depending on which of the left arm module 15 or right arm module 20 comprises male stud connectors). For example, as shown in FIG. 4, male stud connectors (not shown) on the left exterior surface of the left seat module 50A have been connected to female connectors (not shown) on the left arm module 15. The male stud connectors (not shown) on the left exterior surface of the middle seat module 50B can then be connected to female connectors 30 on the left seat module 50A. Next, the male stud connectors 25 on the left exterior surface of the right seat module 50C can be connected to female connectors (not shown) on the right exterior surface of the middle seat module 50B. Finally, the male stud connectors 25 of the right arm module can be connected to female connectors (not shown) on the right exterior surface of the right seat module 50C. This would be an example of connecting the modules from left to right using the male stud connectors and female connectors (as the left arm module comprises female connectors while the right arm module comprises male connectors). If the left arm module comprised male stud connectors while the right arm module comprised female connectors, it would be easier to assemble the modular seat assembly from right to left.

Figure 5:
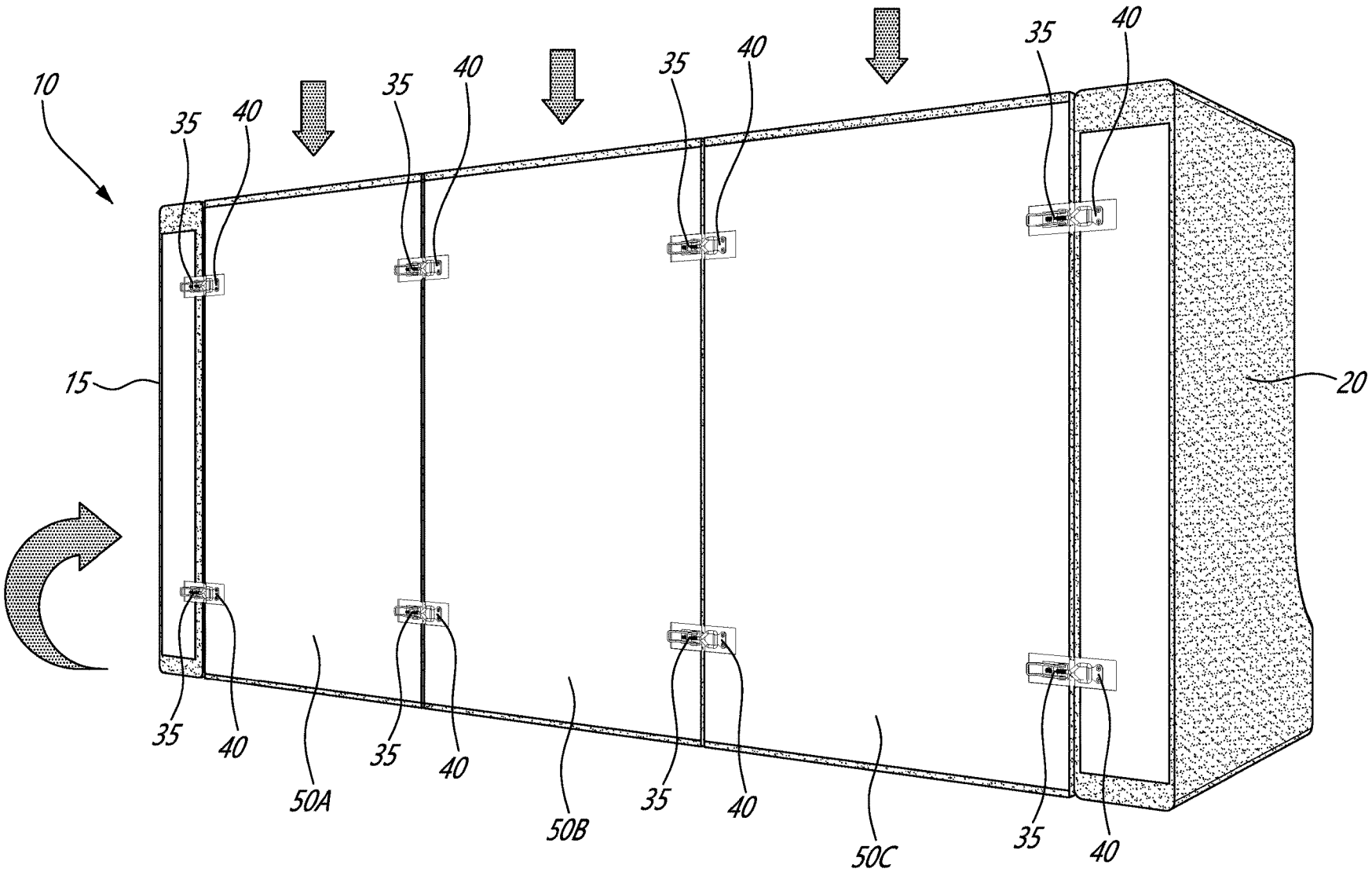
FIG. 5 is a bottom isometric view of the modular seat assembly of FIG. 1 in a partially assembled form.

Furthermore, referring to FIG. 5, each of an edge of a right side of a bottom exterior surface of the left arm module 15 and an edge of a left side of a bottom exterior surface of the right arm module 20 comprise at least one latch 35 or at least one latch receiving means 40 and further comprise at least one leg module receiving means 45. In preferred embodiments (and as shown for example in FIG. 5), each of the edge of the right side of the bottom exterior surface of the left arm module 15 and the edge of the left side of the bottom exterior surface of the right arm module 20 comprise two latches 35 or two latch receiving means 40 and further comprise two leg module receiving means 45 (shown in FIG. 6).

As also shown in FIG. 5, each of an edge of a right side and an edge of a left side of a bottom exterior surface of each seat module comprises one or more latches 35 or one or more latch receiving means 40 and further comprises one or more leg module receiving means 45.

In the embodiment shown in FIG. 5, the edge of the right side of the bottom exterior surface of the left arm module 15 comprises two latches 35 and further comprises two leg module receiving means 45, while the edge of the left side of the bottom exterior surface of the right arm module 20 comprises two latch receiving means 40 and further comprises two leg module receiving means 45. However, the skilled person would understand that each of the edge of the right side of the bottom exterior surface of the left arm module 15, the edge of the left side of the bottom exterior surface of the right arm module 20, and the edge of the right side and the edge of the left side of the bottom exterior surface of each seat module can comprise either latches 35 or latch receiving means 40, so long as each latch 35 has a corresponding latch receiving means 40 when the modular seat is assembled.

The skilled person would also understand that the purpose of the latches 35 and the latch receiving means 40 is to allow a user to easily secure the left arm module, the right arm module, and the seat modules to each other. While using more pairs of latches 35 and latch receiving means 40 will generally render the resulting assembly more secure, it will also increase manufacturing costs and render the assembly more difficult and/or cumbersome to assemble.

Figure 6:
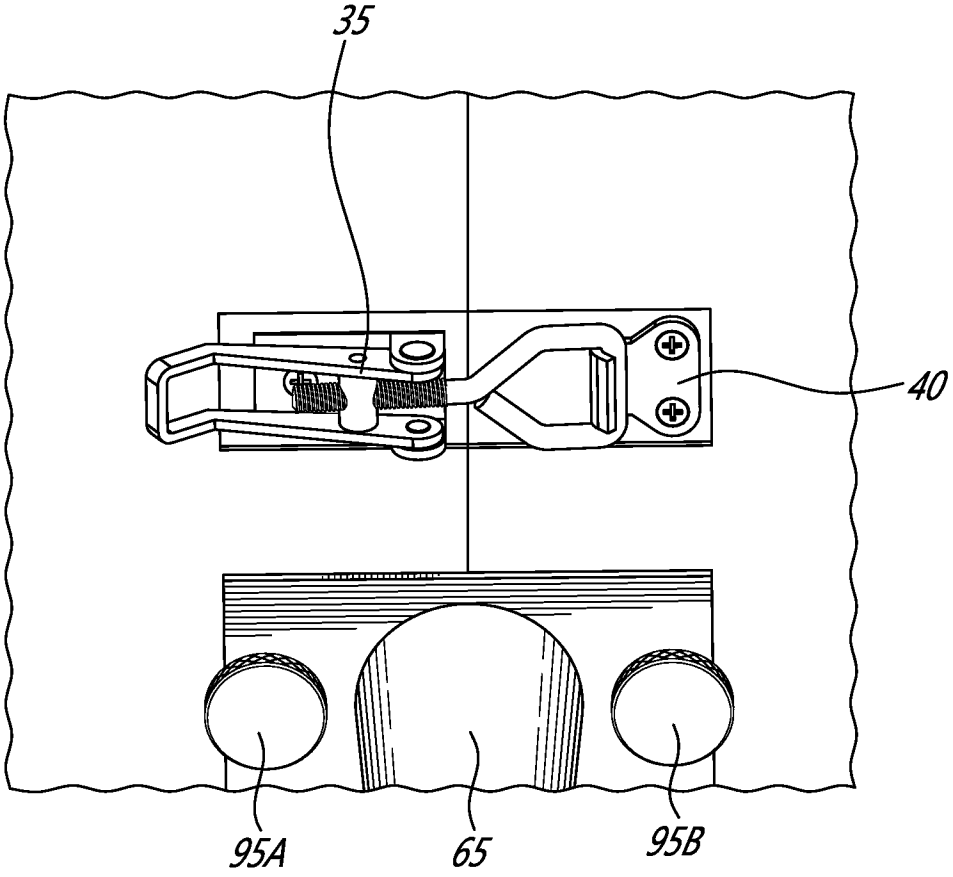
FIG. 6 is a close up of a portion of a bottom isometric view of the modular seat assembly of FIG. 1 in an assembled form.

In preferred embodiments, and as shown in FIGS. 5 and 6, for example, the latches 35 are toggle latches, and the latch receiving means 40 are latch plates configured to receive the toggle latches 35, the reach of the toggle latches preferably being adjustable with a screw, as shown in FIG. 6, for example.

As shown in FIG. 5, each latch receiving means 40 is positioned and configured to releasably connect to a corresponding latch 35, respectively, on an adjacent seat module 50, on the right arm module 20, or on the left arm module 15. As an example, latches 35 are positioned on the left arm module 15 so that they can be received by the latch receiving means 40 on adjacent seat module 50A. Similarly, latches 35 are positioned on seat module 50A so that they can be received by the latch receiving means 40 on adjacent seat module 50B.

Figure 7:
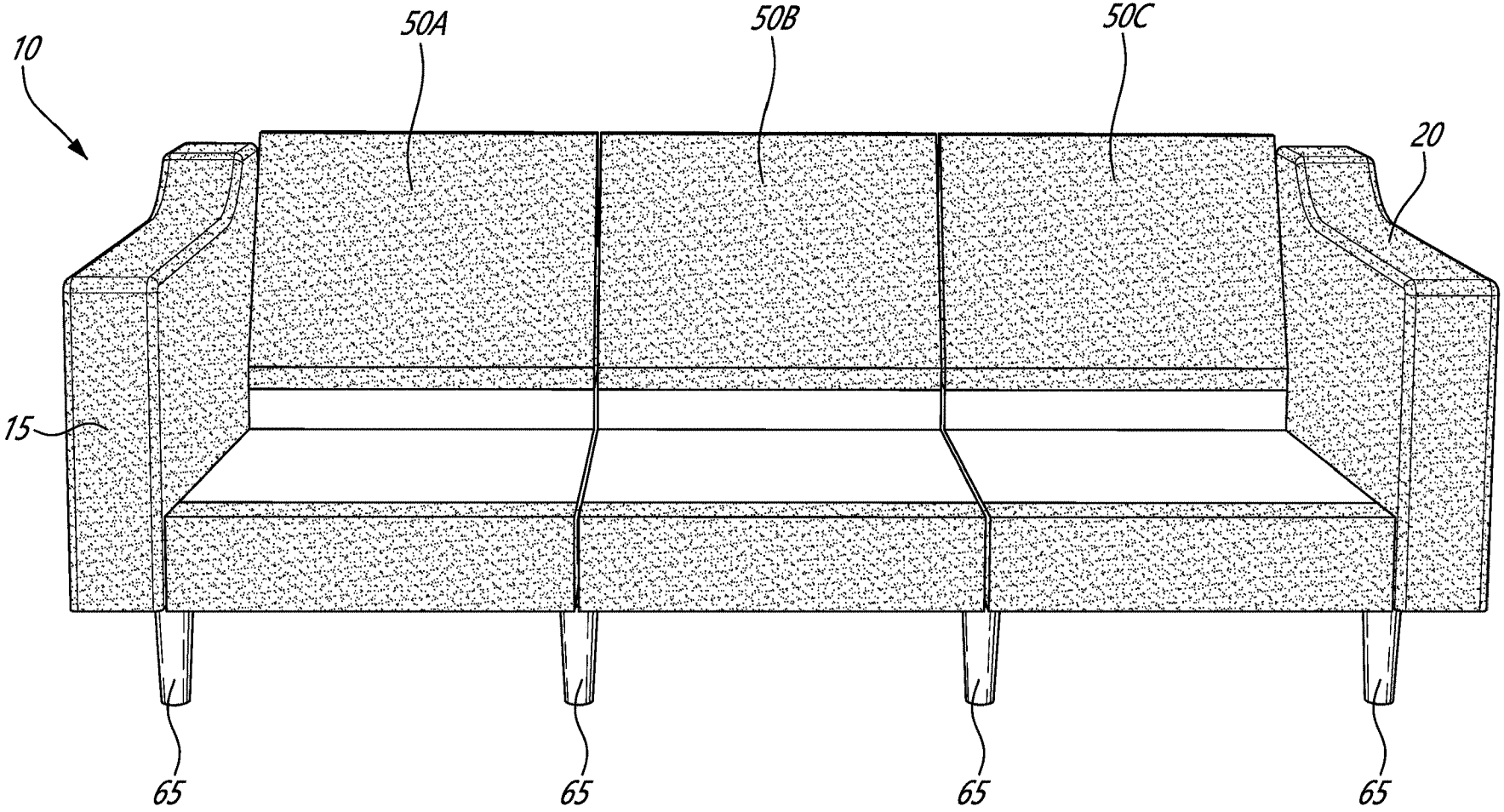
FIG. 7 is a front isometric view of the modular seat assembly of FIG. 1 in an assembled form.

As shown in FIGS. 6 and 7, the modular seat assembly further comprises a plurality of leg modules 65. FIG. 7 shows the modular seat assembly of FIG. 1 in an assembled state.

As shown in FIG. 6, each leg module receiving means 45 is positioned so as to be adjacent to another leg module receiving means 45 on an adjacent seat module 50, on the right arm module 20, or on the left arm module 15, such that each leg module 65 is releasably connectable to two adjacent leg module receiving means 45. As shown in FIG. 6, each leg module 65 is releasably connectable to two adjacent leg module receiving means 45. The skilled person would understand that the purpose of having each leg module 65 be releasably connectable to two adjacent leg module receiving means 45 is to allow a user to easily secure the left arm module, the right arm module, and the seat modules to each other (as they will be held together by the leg modules). While using a greater number of leg modules 65 and adjacent leg module receiving means 45 will generally render the resulting assembly more secure, it will also increase manufacturing costs and render the assembly more difficult and/or cumbersome to assemble.

In FIG. 6, the leg module is releasably connectable to two adjacent leg module receiving means 45 using hand screws 95A 95B. In preferred embodiments, the leg module receiving means are plates.

In preferred embodiments, the leg module receiving means, when connected to two adjacent leg module receiving means, are primarily responsible for the sturdiness of the modular seat assembly (when compared to the latches and latch receiving means and the male stud connectors and the female connectors). In such embodiments, the male stud connectors and female connectors are used to loosely secure the modules together (such that alignment adjustments can still be made), and the latches and latch receiving means can be used to provide additional sturdiness and to bring the modules closer together. In such embodiments, most of the connection and sturdiness are being created by the leg modules, which hold the modules together and each takes the weight of two different modules at the same time.

In embodiments, by combining male stud connectors 25 and female connectors 30; latches 35 and latch receiving means 40; and leg modules 65 and adjacent leg module receiving means 45, the modular seat assembly of the present invention can more easily assembled and can be more secure, once assembled (specifically, the left arm module, the right arm module, and the seat modules are more secured to each other). In preferred embodiments, each seat module 50A 50B 50C comprises the same number of male stud connectors 25, female connectors 30, latches 35, latch receiving means 40, and leg module receiving means 45, each of which are in the same position on their corresponding seat module 50A 50B 50C. This would render the seat modules virtually identical, such that they can be arranged in any order in the modular seat assembly, or some seat modules can even be easily removed/added in order to change the size of the modular seat assembly, depending on the needs of the user.

Figure 8:
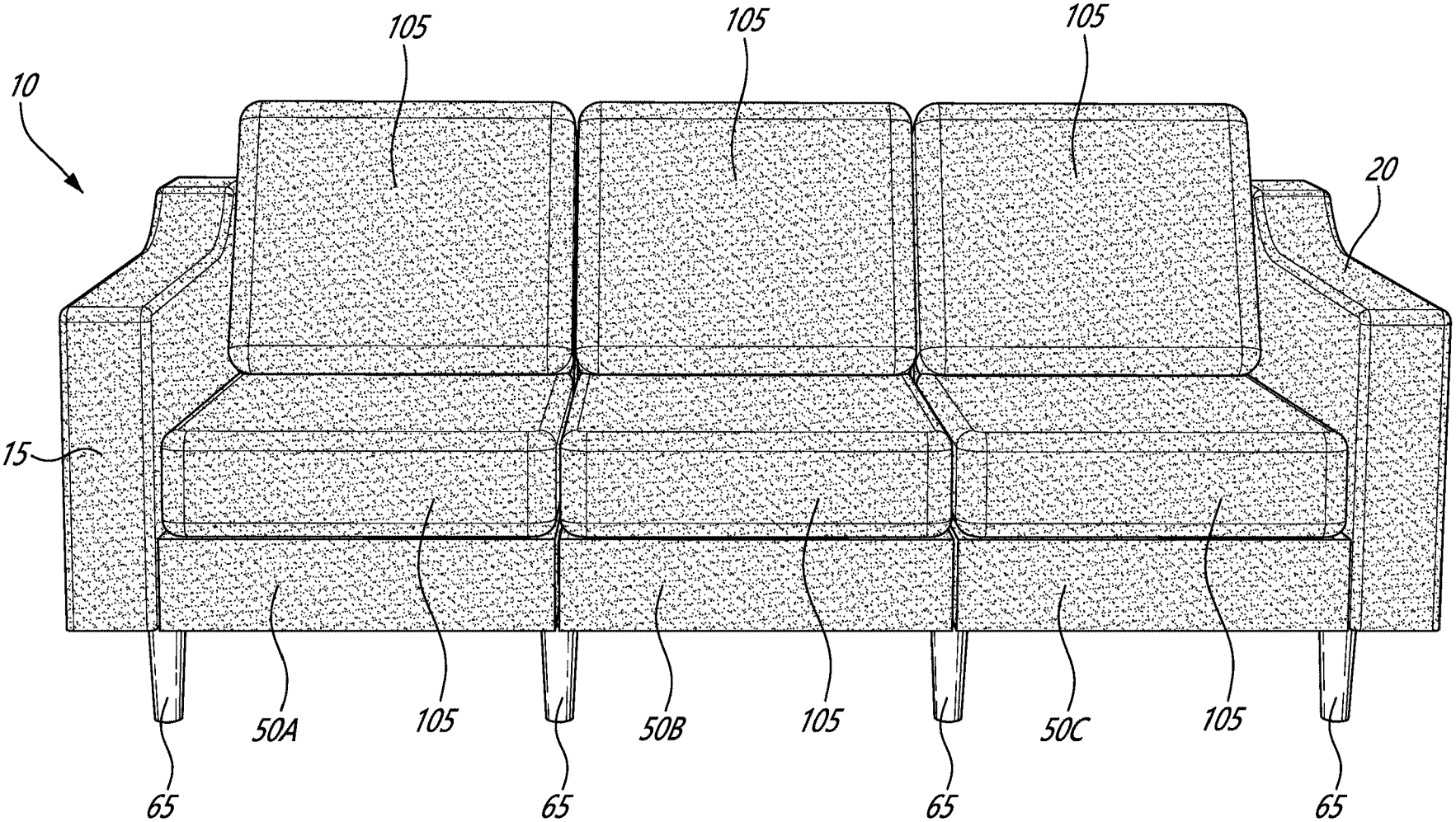
FIG. 8 is a front isometric view of the modular seat assembly of FIG. 1 in an assembled form, further comprising cushions placed thereon.

In embodiments, the modular seat assembly can further comprise cushions 105 for a user to sit on. In embodiments, the cushions 105 are integral to the seat modules (for example, by being stitched thereon). In alternative and preferred embodiments, such as that shown in FIG. 8, the cushions are removably placeable on the seat modules. In preferred embodiments, such as that shown in FIG. 8, each seat module has a seat cushion for the sitting portion 55 and a back cushion for the backrest portion.

In embodiments (not shown) of the modular seat assembly of the present invention, the sitting portion 55 and the backrest portion 60 are integral to each other, meaning they cannot be separated.

Figure 9:
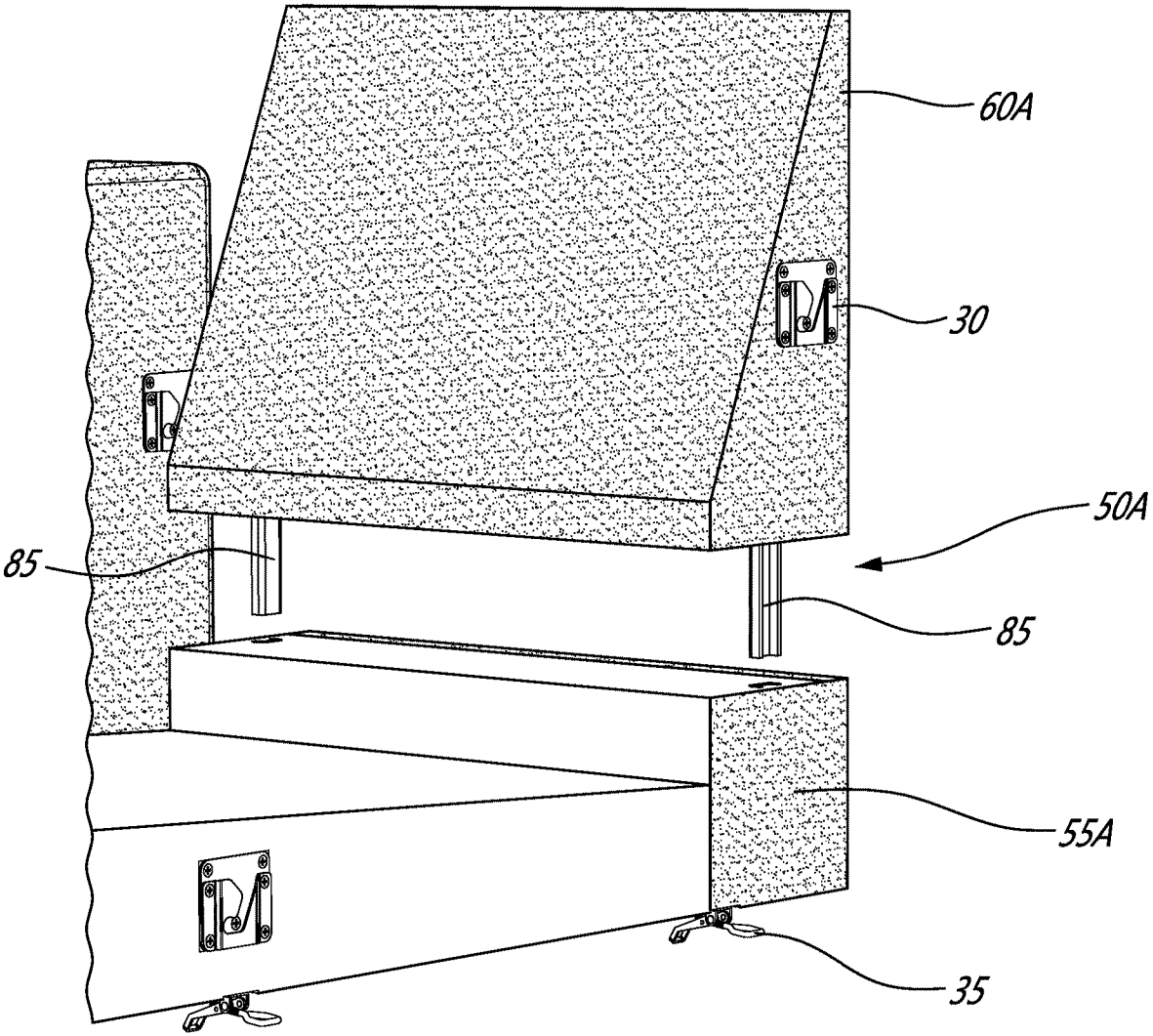
FIG. 9 is an isometric view of a sitting portion and a backrest portion of a seat module of the modular seat assembly of FIG. 1.

In alternative and preferred embodiments of the modular seat assembly of the present invention, such as that shown in FIG. 1, the sitting portion 55 and the backrest portion 60 are releasably connectable to each other. This can be accomplished using any method known by the skilled person in the art, so long as the sitting portion 55 and the backrest portion 60 can be connected easily and in a manner secure enough for use. In embodiments, and as shown in FIG. 9, for example, the bottom exterior surface of the backrest portion may comprise a plurality of pins 85 configured to be received by a plurality of openings 90 in the top exterior surface of the sitting portion, such that the sitting portion and the backrest portion are releasably connectable to each other.

The skilled person would understand that a different number of seat modules can be used in the modular seat assembly of the present invention. For example, the embodiment shown in FIGS. 1-9 comprises three seat modules 50A 50B 50C, such that the modular seat assembly forms a sofa once assembled. In such an embodiment, the left most seat module 50A is releasably connected to the left arm module 15, the right most seat module 50C is releasably connected to the right arm module 20, and the middle seat module 50B is releasably connectable to the left most seat module 50A and the right most seat module 50C.

If a single seat module is used, then the modular seat assembly would form a chair once assembled. In such an embodiment, the single seat module would be releasably connectable to both the left arm module (on the left side of the single seat module) and the right arm module (on the right side of the single seat module).

In embodiments, the modular seat assembly of the present invention comprises 1, 2, 3, or 4 seat modules, more preferably 1, 2, or 3 seat modules, most preferably 3 seat modules. As mentioned, in preferred embodiments, the seat modules are virtually identical to each other so as to allow the user to arrange them in any order, or to use fewer/more seat modules depending on how large they wish the assembled seat assembly to be.

The skilled person would understand that the modular seat assembly can be made of any material known in the art of making seat assemblies (e.g. wood, metal, fabric, combinations thereof). In preferred embodiments, the male stud connectors, the female connectors, the latches, the latch receiving means, the plurality of leg modules, the leg module receiving means are made of wood, metal, or a combination thereof.

In embodiments, in addition to the advantages previously discussed, the modular seat assembly of the present invention can present one or more of the following advantages:

Flexibility in assembly: Since the female connector of the present invention more loosely connects seat modules, the left arm module, and the right arm module together as the male stud connectors can be slid along the horizontal portion of their corresponding female connectors), there is more room to assemble the male hardware into the female part, making the assembly easier for users compared to conventional connectors used for modular seat assemblies (wideness in opening). The increased width of the opening and the downward angle of the channel also renders assembly easier for users compared to conventional connectors used for modular seat assemblies, as the user can easily guide male stud connectors through the opening and the channel, into the horizontal portion.

Easier and cheaper manufacturing: the male stud connector and female connector are placed on the outside (exterior surface) of their respective modules, which makes it much easier and cheaper to produce, when compared to conventional modular seat assemblies.

Ease of replacement: In the case of a defect or a broken male stud connector and/or female connector, the fact that both the male stud connector and female connector are located on the outside (exterior surface) of their respective modules makes it much easier for the user to replace it themselves and can give each module a longer lifetime than if connectors had been located in places that are unreachable.

Preferred Method of Assembling Modular Seat Assembly

In a second aspect of the present invention, a method of assembling the above-defined modular seat assembly is provided, comprising:

releasably connecting the left arm module, the at least one seat module, and the right arm module together by slidably connecting each male stud connector to a corresponding female connector, such that the at least one seat module is bookended by the left arm module and the right arm module;

wherein the step of slidably connecting each male stud connector to a corresponding female connector comprises sliding each male stud connector through the opening of the corresponding female connector, and through the downwardly angled channel extending into the horizontal portion.

In preferred embodiments, the step of releasably connecting the left arm module, the at least one seat module, and the right arm module together is performed from left to right or right to left, if only one of the left arm module or the right arm module comprises male connectors (see previous section for more detail).

Once the left arm module, the at least one seat module, and the right arm module are releasably connected together using the male stud connectors and the female stud connectors, if not properly aligned, the seat modules, the left arm module, and the right arm module can be aligned together by sliding the appropriate male stud connectors along the horizontal portions. The design of the female connectors renders the seat modules, the left arm module, and the right arm module more easily alignable when compared to conventional modular seat assemblies.

In embodiments of the method of the present invention, the step of slidably connecting each male stud connector to its corresponding female connector is performed such that each leg module receiving means is positioned so as to be adjacent to another leg module receiving means on an adjacent seat module, on the right arm module, or on the left arm module. In such embodiments, the method further comprises the step of releasably connecting each leg module to two adjacent leg module receiving means. In preferred embodiments, the step of releasably connecting each leg module to two adjacent leg module receiving means is performed using hand screws.

In embodiments of the method of the preset invention, the method further comprises the step of releasably engaging each latch with its corresponding latch receiving means. In preferred embodiments, this step is performed after releasably connecting each leg module to two adjacent leg module receiving means.

In preferred embodiments, the modular seat assembly is flipped on its back, as shown in FIG. 5, after slidably connecting each male stud connector to a corresponding female connector. This makes it much easier access the leg module receiving means, the latches, and the latch receiving means, thereby making it easier to releasably connect each leg module to two adjacent leg module receiving means and to releasably engage each latch with its corresponding latch receiving means. Furthermore, flipping the sofa on its back (onto a flat surface) can help align the at least one seat module, the left arm module, and the right arm module, as the at least one seat module, the left arm module, and the right arm module will align with the flat surface. In preferred embodiments, the at least one seat module, the left arm module, and the right arm module are aligned by flipping the sofa on its back.

Naturally, if the modular seat assembly has been flipped onto its back during assembly, the modular seat assembly can then be flipped back to an upright position once it has been assembled, such that its weight is borne by the plurality of leg modules.

In embodiments of the method of the present invention, the method further comprises the step of arranging cushions on each seat module. In preferred embodiments, the cushions are arranged on each sitting portion and each backrest portion.

In preferred embodiments of the method of the present invention, prior to releasably connecting the left arm module, the at least one seat module, and the right arm module together, the method further comprises the step of releasably connecting each backrest portion with each sitting portion. In preferred embodiments, this step is performed by inserting a plurality of pins 85 located on the bottom exterior surface of the backrest portion into a plurality of openings in the top exterior surface of the sitting portion as shown for example in FIG. 9.

The scope of the claims should not be limited by the preferred embodiments set forth in the examples, but should be given the broadest interpretation consistent with the description as a whole.

Definitions

The use of the terms "a" and "an" and "the" and similar referents in the context of describing the invention (especially in the context of the following claims) are to be construed to cover both the singular and the plural, unless otherwise indicated herein or clearly contradicted by context.

The terms "comprising", "having", "including", and "containing" are to be construed as open-ended terms (i.e., meaning "including, but not limited to") unless otherwise noted.

Recitation of ranges of values herein are merely intended to serve as a shorthand method of referring individually to each separate value falling within the range, unless otherwise indicated herein, and each separate value is incorporated into the specification as if it were individually recited herein. All subsets of values within the ranges are also incorporated into the specification as if they were individually recited herein.

All methods described herein can be performed in any suitable order unless otherwise indicated herein or otherwise clearly contradicted by context.

The use of any and all examples, or exemplary language (e.g., "such as") provided herein, is intended merely to better illuminate the invention and does not pose a limitation on the scope of the invention unless otherwise claimed.

No language in the specification should be construed as indicating any non-claimed element as essential to the practice of the invention.

Herein, the term "about" has its ordinary meaning. In embodiments, it may mean plus or minus 10% or plus or minus 5% of the numerical value qualified.

Unless otherwise defined, all technical and scientific terms used herein have the same meaning as commonly understood by one of ordinary skill in the art to which this invention belongs.

The invention claimed is:

1. A method of assembling a modular seat assembly (10), comprising:

a left arm module and a right arm module (20), each of a right exterior surface of the left arm module (15) and a left exterior surface of the right arm module (20) comprising at least one male stud connector (25) or at least one female connector (30), at least one seat module (50) comprising a sitting portion (55) and a backrest portion (60), each of a right exterior surface and a left exterior surface of each seat module (50) comprising one or more male stud connectors (25) or one or more female connectors (30), wherein each female connector (30) is positioned and configured to releasably connect to a corresponding male stud connector (25) on an adjacent seat module (50), on the right arm module (20), or on the left arm module (15);

wherein each female connector (30) comprises a plate (110) comprising a raised portion (115) defining an upper opening (70) leading to a downwardly angled channel (75) extending at about 20 degrees to about 70 degrees from a vertical axis into a horizontal portion (80), such that each male stud connector (25) is slidably and releasably connectable to each corresponding female connector (30), and such that the channel (75) and the horizontal portion (80) have a width that is narrower than a head (100) of the male stud connector (25), but wider than a neck of the male stud connector (25); and wherein said male stud connector (25) is configured to be guided downward by said channel (75) and then loosely contained within said horizontal portion (80);

said method comprising:

releasably connecting the left arm module (15), the at least one seat module (50), and the right arm module (20) together by slidably connecting each male stud connector (25) to a corresponding female connector (30), such that the at least one seat module (50) is bookended by the left arm module (15) and the right arm module (20);

wherein the step of slidably connecting each male stud connector (25) to a corresponding female connector (30) comprises sliding each male stud connector (25) through the opening (70) of the corresponding female connector (30), and through the downwardly angled channel (75) extending into the horizontal portion (80) and said method comprising releasably connecting each leg module (65) to two adjacent leg module receiving means (45), and releasably engaging each latch (35) with its corresponding latch receiving means (40).

2. The method of claim 1, wherein the left arm module (15) comprises two female connectors (30) or two male stud connectors (25) on the right exterior surface thereof, and the right arm module (20) comprises two male stud connectors (25) or two female connectors (30) on the left exterior surface thereof.

3. The method of claim 1, wherein the plate (110) of the female connector (30) is secured to a back plate (120) that is attachable to the exterior surface of its corresponding module.

4. The method of claim 1, wherein the opening (70) is of a gradually decreasing width, such that is it about the same width as the channel (75) once it reaches the channel (75).

5. The method of claim 1, wherein the downward angle of the channel (75) is about 30 degrees.

6. The method of claim 1, wherein each seat module (50) comprises both one or more male stud connectors (25) on one side thereof and one or more female connectors (30) on the other side thereof.

7. The method of claim 1, wherein the modular seat assembly (10) further comprises a plurality of leg modules (65), each of an edge of a right side of a bottom exterior surface of the left arm module (15) and an edge of a left side of a bottom exterior surface of the right arm module (20) comprise at least one latch (35) or at least one latch receiving means (40) and further comprise at least one leg module receiving means (45), and each of an edge of a right side and an edge of a left side of a bottom exterior surface of each seat module (50) comprises one or more latches (35) or one or more latch receiving means (40) and further comprises one or more leg module receiving means (45), wherein each latch receiving means (40) is positioned and configured to releasably connect to a corresponding latch (35), respectively, on an adjacent seat module (50), on the right arm module (20), or on the left arm module (15), and each leg module receiving means (45) is positioned so as to be adjacent to another leg module receiving means (45) on an adjacent seat module (50), on the right arm module (20), or on the left arm module (15), such that each leg module (65) is releasably connectable to two adjacent leg module receiving means (45).

8. The method of claim 7, wherein the latches (35) are toggle latches, and the latch receiving means (40) are latch plates configured to receive the toggle latches (35).

9. The method of claim 7, wherein each leg module (65) is releasably connectable to two adjacent leg module receiving means (45) using hand screws (95A 95B).

10. The method of claim 1, wherein the sitting portion (55) and the backrest portion (60) are releasably connectable to each other.

11. The method of claim 1, wherein the bottom exterior surface of the backrest portion (60) comprises a plurality of pins (85) configured to be received by a plurality of openings (90) in the top exterior surface of the sitting portion (55), such that the sitting portion (55) and the backrest portion (60) are releasably connectable to each other.

12. The method of claim 1, comprising three seat modules (50A, 50B, 50C), such that the modular seat assembly (10) forms a sofa once assembled.

13. The method of claim 1, comprising a single seat module (50), such that the modular seat assembly (10) forms a chair once assembled.

14. The method according to claim 1, wherein the step of releasably connecting the left arm module (15), the at least one seat module (50), and the right arm module (20) together is performed from left to right or right to left.

15. The method according to claim 1, wherein, if not properly aligned, the seat modules (50), the left arm module (15), and the right arm module (20) are aligned together by sliding the appropriate male stud connectors (25) along the horizontal portions (80).

16. The method according to claim 1, comprising flipping the modular seat assembly (10) on its back after slidably connecting each male stud connector (25) to a corresponding female connector (30).

17. The method according to claim 1, wherein, prior to releasably connecting the left arm module (15), the at least one seat module (50), and the right arm module (20) together, the method further comprises the step of releasably connecting each backrest portion (60) with each sitting portion (55).

* * * * *